US005664279A

United States Patent [19]

Vosbikian

[11] Patent Number: 5,664,279

[45] Date of Patent: Sep. 9, 1997

[54] COMBINED BROOM AND DUSTPAN

[75] Inventor: John Vosbikian, Medford, N.J.

[73] Assignee: Big Ideas, L.L.C., Medford, N.J.

[21] Appl. No.: 608,120

[22] Filed: Feb. 28, 1996

[51] Int. Cl.[6] ..... A47L 13/52

[52] U.S. Cl. ..... 15/175; 15/168; 15/171; 15/257.2; 15/257.1

[58] Field of Search ..... 15/105, 168, 170, 15/171, 175, 257.1, 257.2, 257.3, 257.4, 257.6, 257.7, 257.8, 257.9

[56] References Cited

U.S. PATENT DOCUMENTS

| | | | |
|---|---|---|---|
| 452,358 | 5/1891 | Bishop | 15/257.2 |
| 468,433 | 2/1892 | Bishop | 15/257.7 |
| 1,984,491 | 12/1934 | Ozdobinski | 15/168 |
| 1,990,026 | 2/1935 | Glen, Jr. | 15/257.6 |
| 2,553,727 | 5/1951 | Schlutz . | |
| 2,849,743 | 9/1958 | McFarland . | |
| 3,029,455 | 4/1962 | Siculan . | |
| 3,082,455 | 3/1963 | Evancha . | |
| 3,733,636 | 5/1973 | Osadasky | 15/257.2 |
| 4,050,110 | 9/1977 | Donnelly | 15/257.2 |
| 4,109,338 | 8/1978 | Mertes . | |
| 5,367,737 | 11/1994 | Vosbikian et al. . | |
| 5,425,153 | 6/1995 | Vosbikian . | |

*Primary Examiner*—David Scherbel
*Assistant Examiner*—Randall Chin
*Attorney, Agent, or Firm*—Norman E. Lehrer

[57] ABSTRACT

A broom and dustpan combination wherein the broom includes an elongated handle and a body of straw-like members secured to and extending downwardly from an end of the elongated handle. A shroud member is secured to the top of the body of straw-like members and has a front wall, a rear wall, a top wall and a substantially open bottom. The body of straw-like members is positioned between the front and rear walls of the shroud member. The shroud member includes a pair of spaced apart rail members for retaining the dustpan which is adapted to slidably fit therebetween.

14 Claims, 2 Drawing Sheets

COMBINED BROOM AND DUSTPAN

BACKGROUND OF THE INVENTION

The present invention is directed toward a combined broom and dustpan and, more particularly, to a foldable dustpan which is slidably receivable in the shroud member of a broom.

Dustpans are frequently used in conjunction with brooms in order to effectively remove dust and debris that have been swept into a pile. While the dustpan and the broom are usually stored in the same place, it is not uncommon for one or the other to be misplaced.

In recognition of the foregoing, several broom and dustpan combinations have been proposed which include means for securing a dustpan to a broom. Examples of such broom/dustpan combinations are disclosed in U.S. Pat. Nos. 2,553,727, 2,849,743, 3,029,455, 3,082,455, 4,109,338, 5,367,737, and 5,425,123. Each of the devices disclosed in these patents discloses the attaching of a dustpan to a conventional sweeping broom by certain means. For example, the patent to Siculan (U.S. Pat. No. 3,029,455) discloses equipping a dustpan with a clip which is receivable in a slot formed in the shroud member of a broom in order to secure the same thereto. Evancha (U.S. Pat. No. 3,082,455), by contrast, discloses a dustpan which has a trough shaped handle which is adapted to frictionally engage the handle of a broom.

None of the aforementioned patents discloses furnishing the shroud member of the broom with means for slidably receiving a dustpan so that the same can be firmly secured to the broom and can be readily removed therefrom. Further, none of the patents discloses a way to compactly and conveniently store the dustpan when the same is not in use.

SUMMARY OF THE INVENTION

The present invention is designed to overcome the deficiencies of the prior art discussed above. It is an object of the present invention to provide a combined broom and dustpan which is relatively inexpensive to manufacture.

It is a further object to provide such a broom and dustpan combination which is adapted to easily and firmly secure the dustpan to the shroud member of a broom.

It is yet another object of the invention to provide a broom and dustpan combination that includes a foldable dustpan for compact storage.

In accordance with the illustrative embodiments, demonstrating features and advantages of the present invention, there is provided a broom and dustpan combination wherein the broom includes an elongated handle and a body of straw-like members secured to and extending downwardly from an end of the elongated handle. A shroud member is secured to the top of the body of straw-like members and has an opening formed through the top thereof for allowing passage of the elongated handle. The shroud member includes a pair of spaced apart rail members for retaining the dustpan which is adapted to slidably fit therebetween.

Other objects, features and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
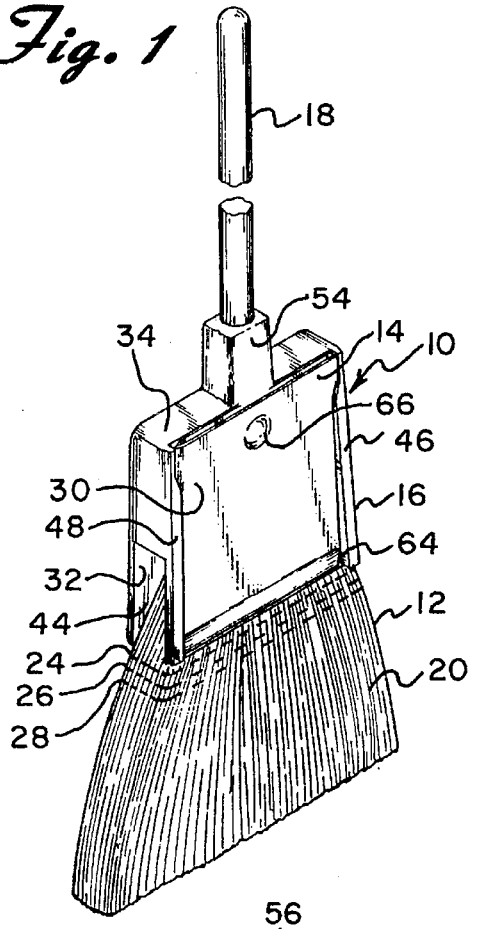
FIG. 1 is a perspective view of the combined broom and dustpan of the present invention.

Referring now to the drawings in detail wherein like reference numerals have been used throughout the various figures to designate like elements, there is shown in FIG. 1 combined broom and dustpan constructed in accordance with the principles of the present invention and designated generally as 10.

The combined broom and dustpan 10 essentially includes a broom 12, a dustpan 14 and a shroud member 16. The broom 12 includes an elongated handle 18 and a body of straw-like members 20. The straw-like members can be comprised of natural broom straw, plastic or the like. The body of straw-like members 20 extends downwardly from the bottom of elongated handle 18 and is secured thereto in a manner well known in the art.

Figure 3:
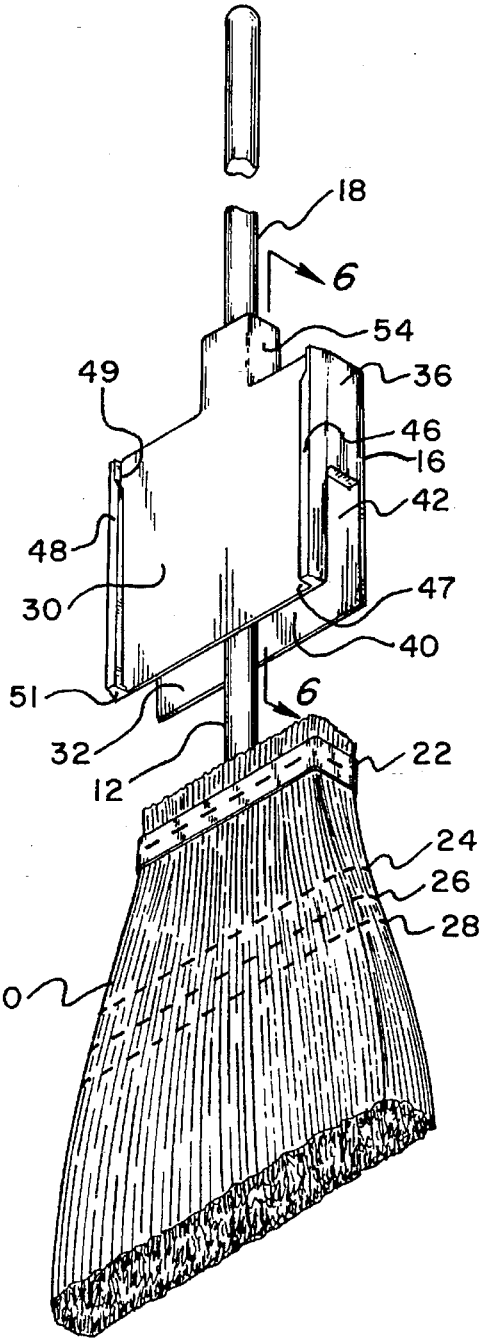
FIG. 3 is an exploded perspective view of the shroud member and the broom.

Specifically, the body of straw-like members 20 is held together by a band 22 secured around the body 20 adjacent the top thereof along with several spaced apart rows of stitching 24, 26 and 28 (FIGS. 1 and 3). The band 22 includes means for securing its free ends together (e.g., staples or the like). The band firmly holds the body of straw-like members against the handle, thereby securing them in place.

Figure 2:
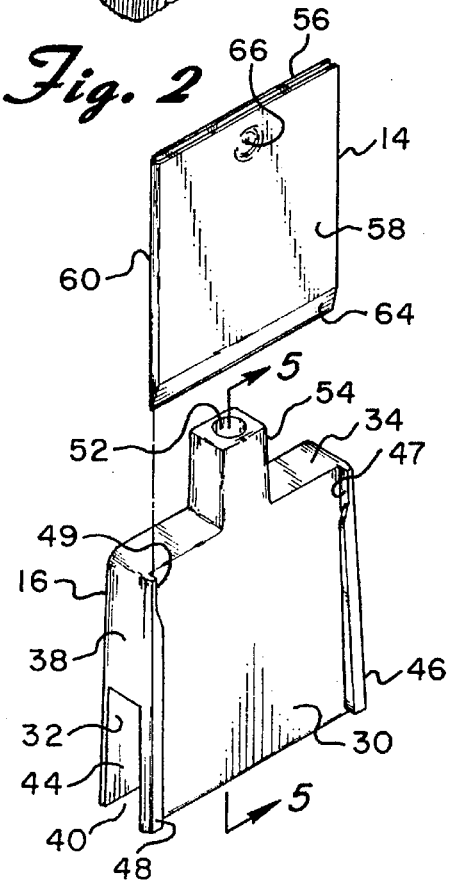
FIG. 2 is an exploded perspective view the dustpan and shroud member.

Referring to FIGS. 1–3, the shroud member 16 includes a front wall 30, a rear wall 32, a top wall 34, opposing side walls 36 and 38, and an open bottom end 40. The shroud member is preferably comprised of a plastic material. However, the shroud member can be made of a variety of other materials.

In the preferred embodiment, each of the side walls 36 and 38 extends downwardly from the top wall 34 to a point above the lowermost portion of the shroud member 16. An elongated opening 42 is formed in side wall 36. Similarly, an elongated opening 44 is formed in side wall 38. The elongated openings allow the shroud member to be fitted over the top portion of a body of straw-like members that has a larger length than the length of the shroud member. Specifically, the straw-like members can extend beyond the elongated openings in the shroud member.

Figure 5:
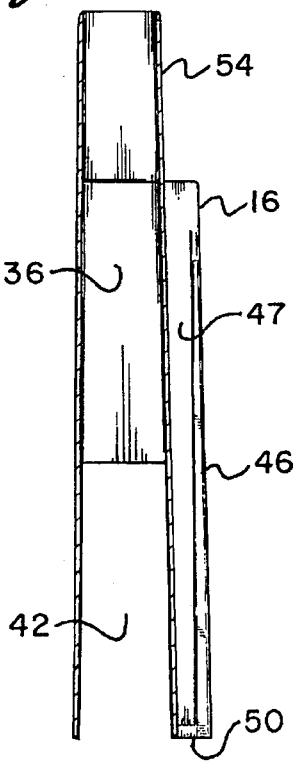
FIG. 5 is a cross-sectional view taken along lines 5—5 of FIG. 2.

Extending forwardly from the front wall 30 of the shroud member are two opposing rail members 46 and 48. The rail members are designed to slidably receive the dustpan 14 in slots 47 and 49 therein as more fully described below. In the preferred embodiment, at least one of the rail members 46 and 48 includes a stop member 50 or 51 for preventing gravity from causing the dustpan 14 from falling downwardly passed the bottom of the shroud member (FIGS. 3 and 5). It should be readily apparent that either or both of the rail members can include a stop member.

Figure 6:
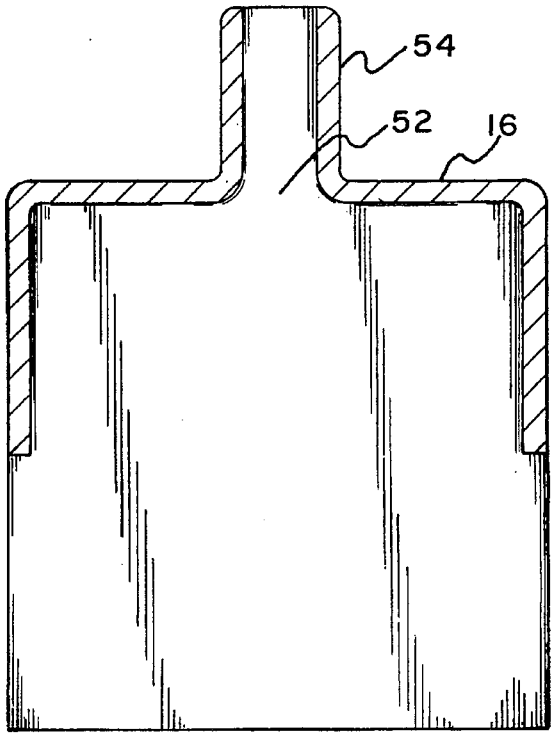
FIG. 6 is a cross-sectional view taken along lines 6—6 of FIG. 3.

The top wall 34 of the shroud member 16 has an opening 52 formed therethrough (FIG. 6). In the preferred embodiment, a reinforcing member 54 extends upwardly from the top wall 34 of the shroud member around the periphery of the opening 52. The reinforcing member 54 ensures a secure fit between the shroud member 16 and the elongated handle 18 when the latter extends upwardly through the former.

In the preferred embodiment the shroud member 16 of the present invention is secured directly to the body of straw-like members. However, it should be noted that the shroud member 16 can be designed to fit over the shroud member of a conventional broom in order to provide the same with a means for securing a dustpan thereto.

Figure 4:
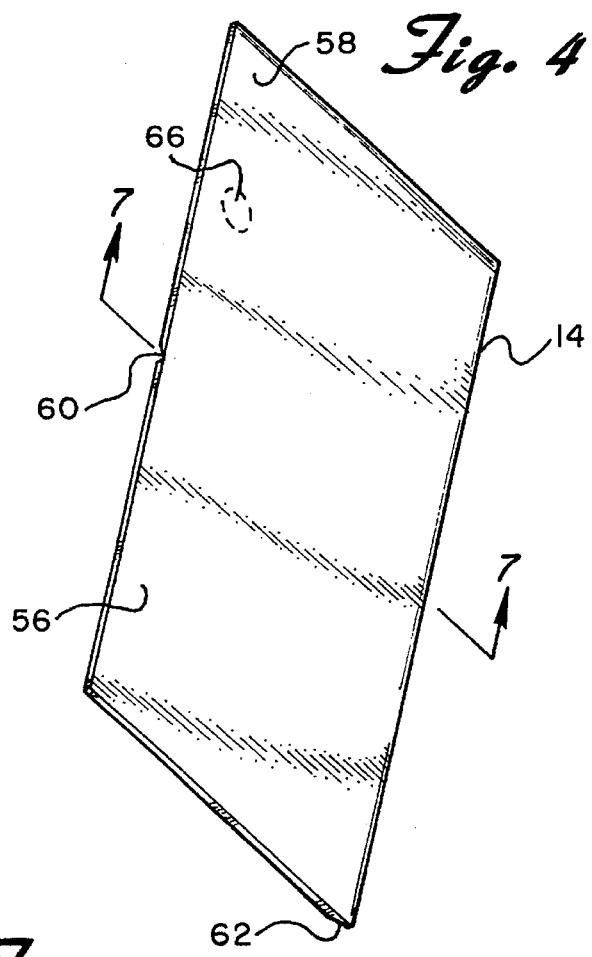
FIG. 4 is a perspective view of the dustpan in the unfolded condition.
Figure 7:
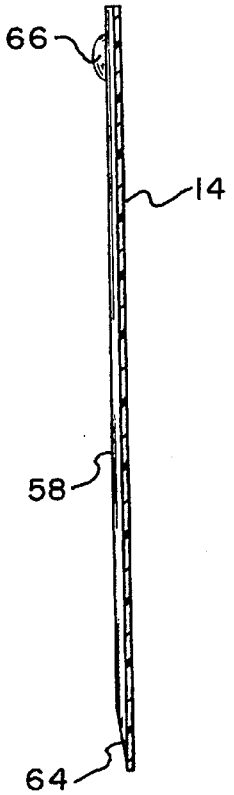
FIG. 7 is a cross-sectional view taken along lines 7—7 of FIG. 4.

Referring to FIG. 4, the dustpan 14 preferably includes a first panel 56 and a second panel 58 connected to one another by a living hinge 60. Accordingly, the dustpan can be moved from an open position (FIG. 4), wherein the first and second panels are substantially side-by-side, to a folded position, wherein the first panel overlies the second panel (FIGS. 1 and 2). The first and second panels preferably have a beveled edge 62 and 64, respectively. The beveled edges facilitate the receipt of dust particles and the like that are swept up onto the dustpan 14 by the broom 12. The dustpan is preferably comprised of plastic such as high density polyethylene. However, it can be comprised of other materials.

In the preferred embodiment, the second panel 58 has a bump or other raised element 66 extending outwardly from one side thereof. The bump 66 provides a means to grip the dustpan 14 when it is located between the rail members 46 and 48 in order to readily contact and slide the dustpan upwardly therefrom.

In order to facilitate an understanding of the principles associated with the foregoing broom and dustpan combination, its operation will now be briefly described. A person uses the broom 12 to sweep dust particles and the like into a pile. Thereafter, he or she places a finger on the bump 66 of the dustpan 14 and slides the same upwardly from between the rail members 46 and 48 of the shroud member 16. The dustpan 14, upon removal from the shroud member, is maneuvered into the open position by unfolding the two panels 56 and 58 so that they are substantially side-by-side. The dustpan is placed on the ground in front of the pile of dust particles with the beveled edges 62 and 64 facing the same. The person then sweeps the particles onto the dustpan and discards the same into an appropriate receptacle. Once the requisite sweeping is completed, the dustpan is placed into its folded position and is slid between the rail members 46 and 48 of the shroud member 16 to substantially cover the front wall 30 where it is stored until needed.

The present invention may be embodied in other specific forms without departing from the spirit or essential attributes thereof and accordingly reference should be made to the appended claims rather than to the foregoing specification as indicating the scope of the invention.

What is claimed is:

1. A broom and dustpan combination comprising:

a dustpan;

a broom having an elongated handle and a body of straw-like members secured to and extending downwardly from an end of said elongated handle;

a shroud member covering at least a portion of an upper part of said body of straw-like members, said shroud member having at least a front wall having two opposing side edges, said front wall having a top and a bottom, and means positioned adjacent said side edges of said front wall of said shroud member and extending substantially the entire distance between said top and bottom of the same for retaining said dustpan to said front wall of said shroud member between said side edges thereof, said dustpan substantially covering said front wall of said shroud member.

2. The broom and dustpan combination of claim 1 wherein said shroud member further includes a top wall, a rear wall and two opposing side walls, each of said side walls extending between said front and rear walls.

3. The broom and dustpan combination of claim 2 wherein said shroud member further includes an opening formed in said top wall thereof and a reinforcing member extending upwardly from said top wall around the periphery of said opening.

4. The broom and dustpan combination of claim 3 wherein each of said opposing side walls extends downwardly from said top wall to a point above the lowermost portion of said shroud member.

5. The broom and dustpan combination of claim 1 wherein said retaining means includes two opposing rail members extending forwardly from said front wall of said shroud member, said rail members being adapted to slidably receive said dustpan therebetween.

6. The broom and dustpan combination of claim 5 wherein at least one of said rail members includes a stop member for preventing said dustpan from being withdrawn from the bottom of said front wall.

7. The broom and dustpan combination of claim 1 wherein said dustpan includes a first panel, a second panel and a hinge means, said hinge means joining said first and second panels so that said panels are movable between an open position wherein said panels are substantially side-by-side, to a folded position wherein said panels overlie one another.

8. The broom and dustpan combination of claim 7 wherein each of said panels of said dustpan includes a beveled bottom edge for facilitating the accumulation of dust particles and the like.

9. The broom and dustpan combination of claim 7 wherein one of said panels includes gripping means for facilitating the removal of said dustpan from said retaining means.

10. The broom and dustpan combination of claim 9 wherein said gripping means is comprised of a raised element extending from said one of said panels.

11. A broom and dustpan combination comprising:

a dustpan having a first panel, a second panel and a hinge means, said hinge means joining said first and second panels so that said panels are movable between an open position wherein said panels are substantially side-by-side, to a folded position wherein said panels overlie one another;

a broom having an elongated handle and a body of straw-like members secured to and extending downwardly from an end of said elongated handle;

a shroud member covering at least a portion of an upper part of said body of straw-like members, said shroud member having at least a front wall having two opposing side edges, and means positioned adjacent said side edges of said front wall of said shroud member for retaining said dustpan to said front wall of said shroud member.

12. The broom and dustpan combination of claim 11 wherein each of said panels of said dustpan includes a beveled bottom edge for facilitating the accumulation of dust particles and the like.

13. The broom and dustpan combination of claim 11 wherein one of said panels includes gripping means for facilitating the removal of said dustpan from said retaining means.

14. The broom and dustpan combination of claim 13 wherein said gripping means is comprised of a raised element extending from said one of said panels.

* * * * *